US007104720B2

(12) United States Patent
Humphries et al.

(10) Patent No.: US 7,104,720 B2
(45) Date of Patent: Sep. 12, 2006

(54) TRAFFIC NOISE BARRIER SYSTEM

(75) Inventors: Eric C. Humphries, Meriden, CT (US); Stephen D. Barratt, Long Valley, NJ (US)

(73) Assignee: CYRO Industries, Rockaway, NJ (US)

( * ) Notice: Subject to any disclaimer, the term of this patent is extended or adjusted under 35 U.S.C. 154(b) by 0 days.

(21) Appl. No.: 10/718,022

(22) Filed: Nov. 19, 2003

(65) Prior Publication Data

US 2005/0104054 A1 May 19, 2005

(51) Int. Cl.
*E01F 13/00* (2006.01)

(52) U.S. Cl. ..... 404/6; 404/9; 256/13.1

(58) Field of Classification Search ..... 404/6, 404/9; 256/13.1; 181/210
See application file for complete search history.

(56) References Cited

U.S. PATENT DOCUMENTS 3,388,892 A * 6/1968 Case ..... 404/6
4,228,867 A * 10/1980 Wirt ..... 181/210
4,529,174 A * 7/1985 Pickett ..... 256/27
4,643,271 A * 2/1987 Coburn ..... 181/210
4,685,656 A * 8/1987 Lee et al. ..... 256/13.1
4,838,524 A * 6/1989 McKeown et al. ..... 256/24
5,040,352 A * 8/1991 Oberlander et al. ..... 52/786.11
5,052,850 A 10/1991 Bishop ..... 404/6
5,074,705 A * 12/1991 Schmitt ..... 404/6
5,207,302 A * 5/1993 Popp et al. ..... 188/372
5,208,585 A 5/1993 Sprague ..... 340/908.1
5,406,039 A * 4/1995 Rerup et al. ..... 181/210
5,443,324 A * 8/1995 Sullivan ..... 404/6
5,524,875 A * 6/1996 Thommen, Jr. ..... 256/12.5
5,588,786 A * 12/1996 House et al. ..... 405/285
5,678,950 A 10/1997 Junker ..... 404/10
5,942,736 A * 8/1999 Cortonesi ..... 181/289
5,961,099 A * 10/1999 Thommen, Jr. ..... 256/12.5
5,984,044 A * 11/1999 Christensen ..... 181/210
6,006,858 A * 12/1999 Shima et al. ..... 181/210
6,016,887 A * 1/2000 Underhill et al. ..... 181/210
6,190,085 B1 * 2/2001 Johansson ..... 404/6
6,328,284 B1 12/2001 Wilding ..... 256/13.1
6,412,230 B1 7/2002 Zambelli et al. ..... 52/27
6,533,250 B1 3/2003 Arthur ..... 256/13.1
6,551,011 B1 4/2003 Valentine ..... 404/6
6,669,402 B1 * 12/2003 Davis et al. ..... 404/6
6,718,672 B1 * 4/2004 Wieringa ..... 40/612
6,926,461 B1 * 8/2005 Faller et al. ..... 404/6

(Continued)

FOREIGN PATENT DOCUMENTS

FR 2457928 * 12/1999

(Continued)

*Primary Examiner*—Raymond W Addie
(74) *Attorney, Agent, or Firm*—Wiggin and Dana LLP; Gregory S. Rosenblatt

(57) ABSTRACT

A traffic noise barrier system includes a longitudinal barrier and a traffic noise barrier wall. The traffic noise barrier wall is supported by the longitudinal barrier and is spaced apart from a back surface of the longitudinal barrier in a direction away from the path of traffic. Transverse beams attach the longitudinal barrier to the noise barrier wall, and a structure may be placed across the transverse beams for catching debris. Each panel in the plurality of panels may be interconnected by a cable to an adjacent panel or an upstanding post, and each post may be interconnected by a cable and/or bar. The traffic noise barrier wall is preferably positioned at a distance greater than about 18 inches from a front surface of the longitudinal barrier, and more preferably is positioned at a distance greater than about 34 inches from the front surface.

29 Claims, 9 Drawing Sheets

U.S. PATENT DOCUMENTS

| | | | | |
|---|---|---|---|---|
| 2001/0014254 | A1 | 8/2001 | Albritton | 404/6 |
| 2002/0127056 | A1 | 9/2002 | Muller et al. | 404/6 |
| 2003/0057410 | A1 | 3/2003 | Denman et al. | 256/13.1 |
| 2003/0077120 | A1 | 4/2003 | Jonsson et al. | 404/6 |

FOREIGN PATENT DOCUMENTS

| | | |
|---|---|---|
| NL | 1024629 | * 10/2003 |

* cited by examiner

TRAFFIC NOISE BARRIER SYSTEM

BACKGROUND OF THE INVENTION

1. Field of the Invention

This invention relates to traffic noise barriers. More specifically, this invention relates to a traffic noise barrier system for bridge rails and other longitudinal barriers.

2. Description of the Related Art

Traffic noise barrier walls serve to shield otherwise quiet areas from noise caused by automotive, railway, aircraft, marine, or pedestrian traffic. A typical traffic noise barrier wall is from about 4 to 18 feet in height and runs continuously alongside a selected section of a roadway, railway, aircraft runway, waterway, parking lot, walkway, and the like.

One common design of a traffic noise barrier wall includes a plurality of panels of wood or concrete supported by vertically mounted posts. Examples of such noise barrier walls are found in U.S. Pat. Nos. 5,713,170 and 5,537,788, both issued to Elmore et al. Noise barrier walls of this type are suitably sturdy and effective in reducing highway noise; however, such noise barrier walls are usually not designed for vehicle impact. As a result, these noise barriers are located many feet (e.g., 40 feet) from the normal path of traffic. Problematically, space constraints often require that noise barriers be located closer to the path of traffic. One example is when a noise barrier is required on a bridge.

Where space constraints exist, it is not uncommon for noise barriers to be mounted on top of a crash worthy traffic barrier. One example of such an arrangement is found in U.S. Pat. No. 4,214,411 issued to Pickett, wherein panels of transparent material are secured between beams mounted atop a roadside barrier. The transparent panels are effective in providing travelers on the traffic path with a view outside the roadway. However, vehicles impacting the otherwise crash worthy traffic barrier may also strike the noise barrier, creating potential hazards to the impacting vehicle and nearby pedestrians.

The Federal Highway Administration (FHWA) requires all longitudinal barriers used on the National Highway System (NHS) to be crashworthy and to qualify as such according to the testing and acceptance guidelines of the National Cooperative Highway Research Program (NCHRP) Report 350. Under NCHRP Report 350, longitudinal barriers include any device whose primary functions are to prevent vehicular penetration and to safely redirect an errant vehicle away from a hazard outside the normal path of the vehicle (e.g., outside the roadway). Longitudinal barriers include, for example, roadside barriers, median barriers, and bridge rails. For longitudinal barriers, NCHRP Report No. 350 defines six test levels, each of which prescribe test conditions appropriate for a range of highway types, traffic volumes, and other parameters. Test Level 1 (TL-1) and Test Level 2 (TL-2) are intended for low-speed and/or low-volume roads, while Test Level 3 (TL-3) through Test Level 6 (TL-6) are intended for high-speed facilities with increasingly higher traffic volumes. Although NCHRP Report No. 350 offers guidance for the safety performance evaluation of longitudinal and other traffic barriers, it offers no guidance toward the evaluation of attachments on or near these barriers.

Some guidance toward the evaluation of barrier attachments to barriers is provided in a technical paper entitled "Guidelines for Attachments to Bridge Rails and Median Barriers" by Keller et al. Using the Test Levels outlined in NCHRP Report No. 350, Keller et al. identify a "Zone of Intrusion" (ZOI) for a wide variety of traffic barriers, including sloped-face concrete parapets (e.g., New Jersey, Single Slope, F-shape, and open concrete rail), vertical-faced concrete parapets (e.g., vertical wall and open concrete rail), steel corrugated rails (e.g., W-beam and thrie beam), steel tubular rails, steel tubular rails on curbs, combination concrete and steel tube railings, and timber bridge rails. The ZOI represents an envelope around the barrier into which various vehicular components intrude upon the vehicle's impact with the barrier.

For noise barriers and similar attachments, referred to by Keller et al. as "continuous attachments", Keller et al. provide various design considerations that allow such attachments to be placed in the ZOI. One suggestion is to use attachments that will breakaway, allowing the system to deflect upon impact by a vehicle. Where non-breakaway attachments are used, Keller et al. suggest that the design take into account the snag potential of the attachment. Snagging is when a portion of a vehicle engages a vertical element, such as a post, causing deceleration of the vehicle. In addition to snagging concerns, Keller et al. suggest that the potential implications of debris from impacts on these systems be considered because debris associated with the attachment may fall on traffic and/or pedestrians around or below the barrier. Keller et al. also suggest that vehicle occupant compartment intrusion and deformation be considered. Occupant compartment intrusion and deformation is a concern for traffic barrier attachments under two scenarios: (1) a vehicle component is driven into the occupant compartment due to impact with the attachment; or (2) the attachment itself intrudes into or deforms the occupant compartment. While Keller et al. provide various guidelines for the design of barrier attachments, Keller et al. fail to provide a design for a traffic noise barrier wall that would meet their guidelines.

Thus, there is a need for a traffic noise barrier wall for use where space constraints require the noise barrier wall to be located near a selected section of a roadway, railway, aircraft runway, waterway, parking lot, walkway, and the like, and which will prevent vehicle deceleration due to snagging, will reduce or eliminate occupant compartment intrusion and deformation, and which will reduce or eliminate debris concerns.

BRIEF SUMMARY OF THE INVENTION

The above-described and other needs are met by a traffic noise barrier system for use alongside a path of traffic. The traffic noise barrier system includes a longitudinal barrier and a traffic noise barrier wall. The longitudinal barrier has a front surface facing the path of traffic, a top surface adjacent the front surface, and a back surface opposite the front surface. The traffic noise barrier wall is supported by the longitudinal barrier and is spaced apart from the back surface in a direction away from the path of traffic.

In one embodiment, the traffic noise barrier wall includes a plurality of upstanding posts spaced apart from the back surface of the longitudinal barrier in the direction away from the path of traffic, and a plurality of panels supported by the plurality of upstanding posts. The panels may be transparent or opaque. A plurality of transverse beams may extend from the longitudinal barrier to the plurality of upstanding posts for supporting the traffic noise barrier wall. A structure may be placed across the plurality of transverse beams for catching debris falling between the longitudinal barrier and the traffic noise barrier wall. Each panel in the plurality of panels may be interconnected by a cable to an adjacent panel or an upstanding post, and each post may be interconnected by a cable and/or bar.

In one aspect, the front surface of the longitudinal barrier is configured to redirect an errant vehicle and, in a region extending from the top surface of the longitudinal barrier to about 78 inches above a terrain surface of the path of traffic, the traffic noise barrier wall is positioned at a distance greater than about 18 inches from a vertical plane disposed at the front surface of the longitudinal barrier. In one preferred embodiment, the front surface of the longitudinal barrier is configured to redirect an errant vehicle and, in a region extending from the top surface of the longitudinal barrier to about 96 inches above a terrain surface of the path of traffic, the traffic noise barrier wall is positioned at a distance greater than about 34 inches from a vertical plane disposed at the front surface of the longitudinal barrier.

The details of one or more embodiments of the invention are set forth in the accompanying drawings and the description below. Other features, objects and advantages of the invention will be apparent from the description and drawings, and from the claims.

BRIEF DESCRIPTION OF THE DRAWINGS

The invention will be more fully understood from the following detailed description taken in conjunction with the accompanying drawings wherein like elements are numbered alike, and in which.

DETAILED DESCRIPTION

Figure 1:
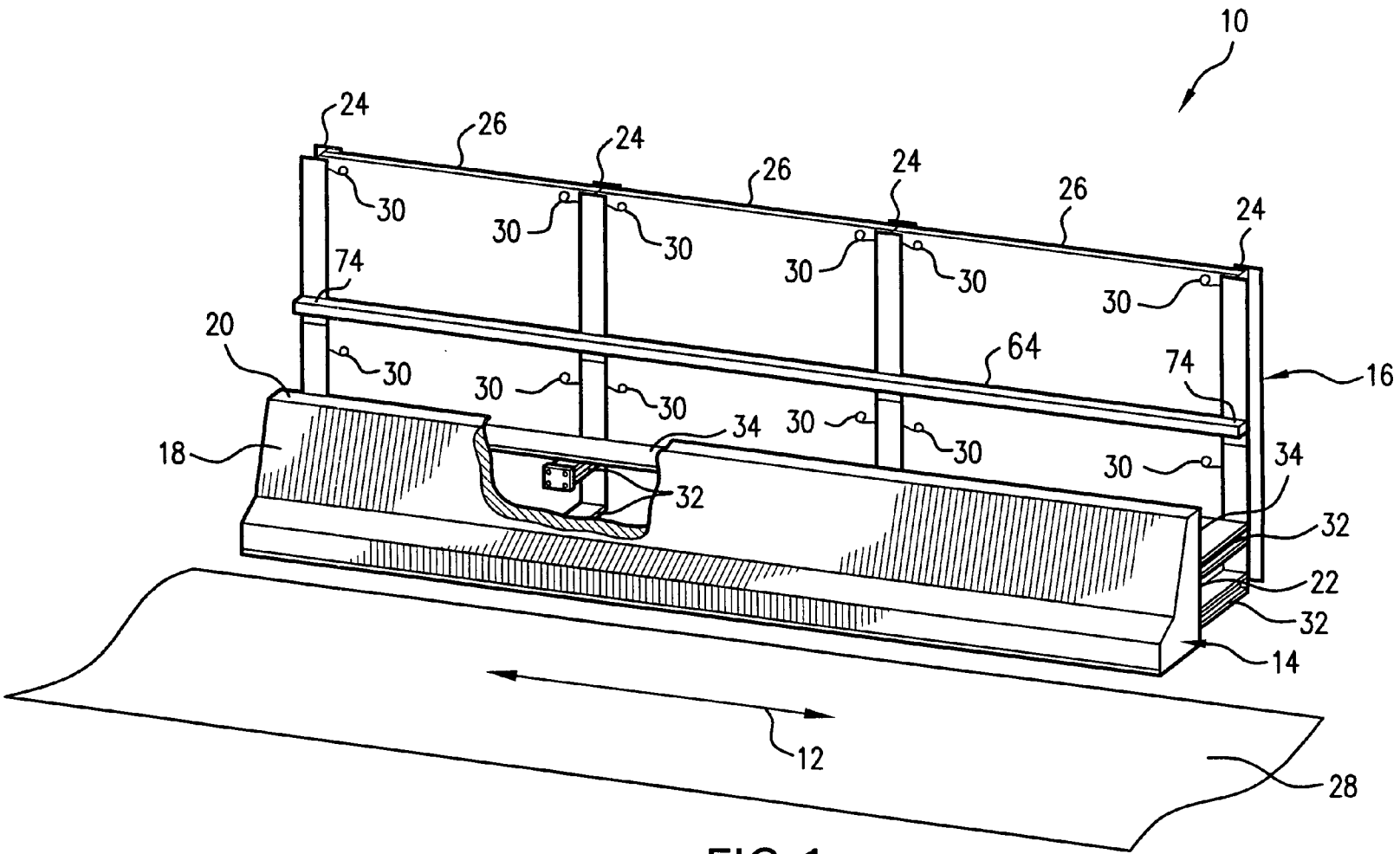
FIG. 1 is a perspective view of a traffic noise barrier system of the present invention.
Figure 2:
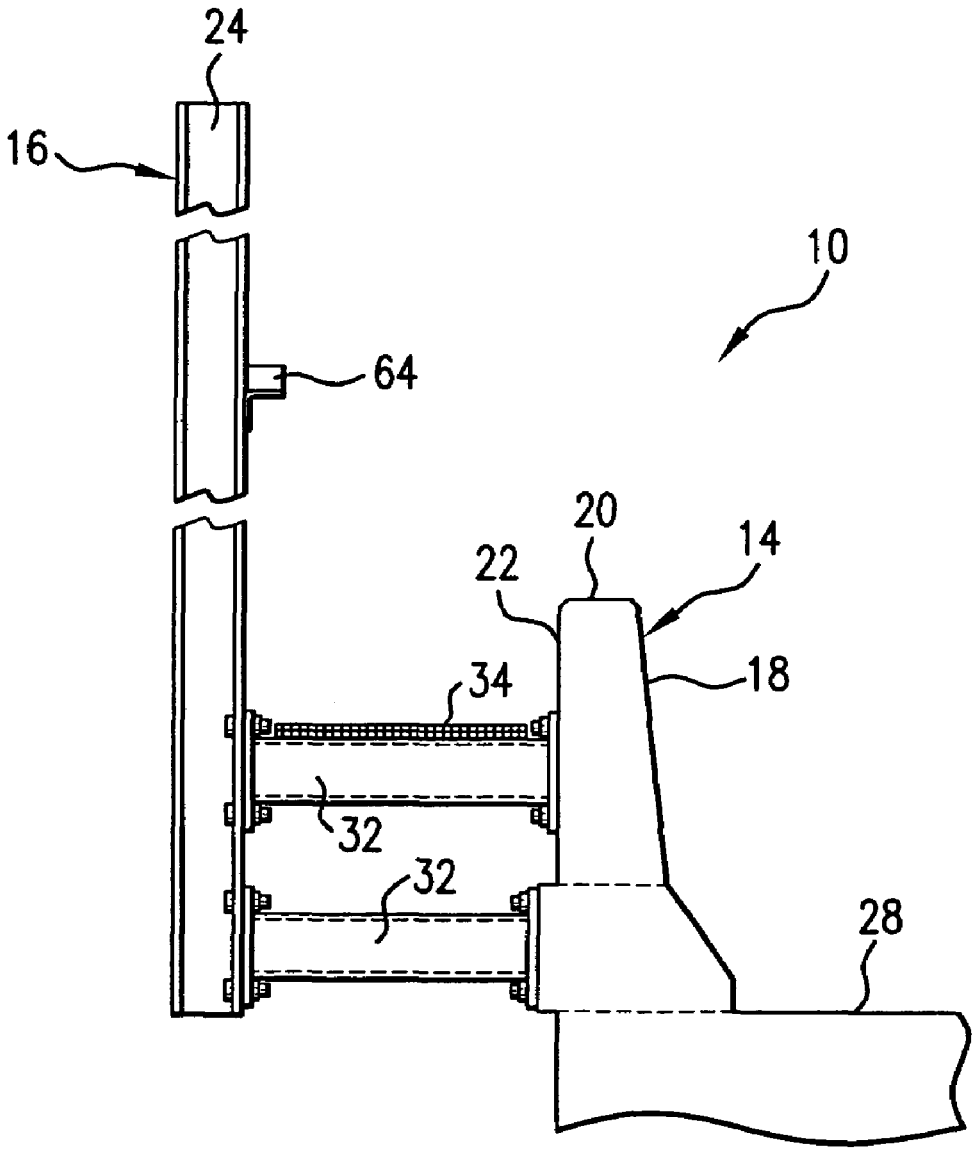
FIG. 2 is a side elevation view of the traffic noise barrier system.
Figure 3:
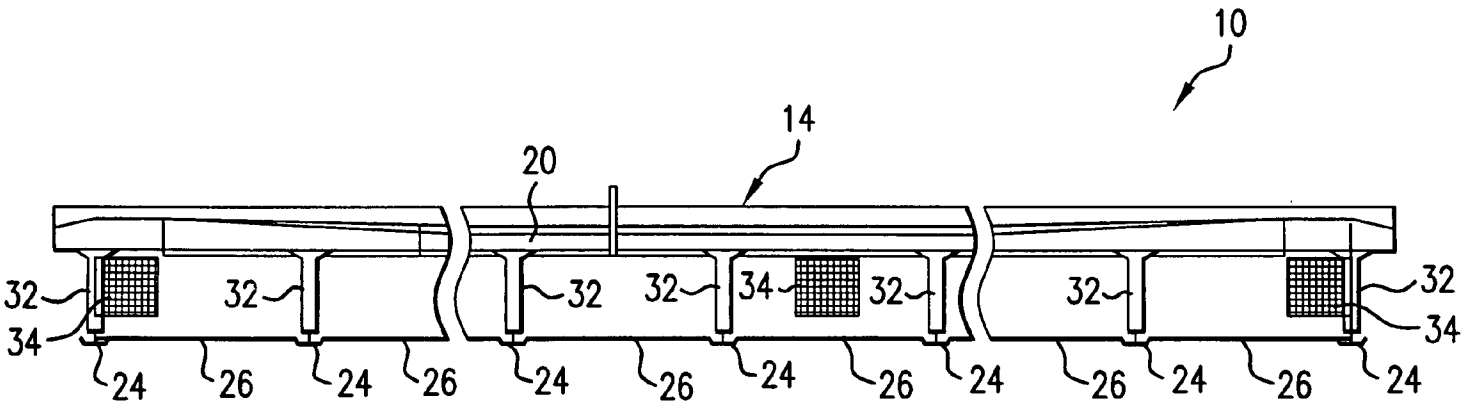
FIG. 3 is a plan view of the traffic noise barrier system.
Figure 4:
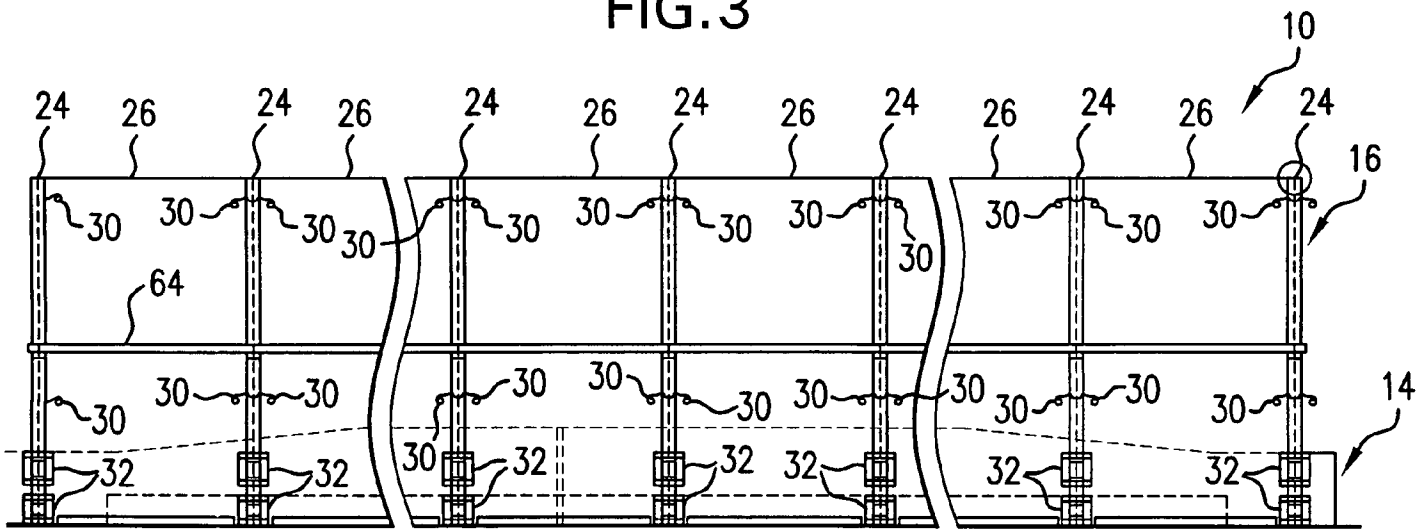
FIG. 4 is a front elevation view of the traffic noise barrier system.

Referring to FIGS. 1 through 4, a traffic noise barrier system 10 for use alongside a path of traffic 12 is shown. FIG. 1 is a perspective view of the system 10, FIG. 2 is a side elevation view of the system 10, FIG. 3 is a top plan view of the system 10, and FIG. 4 is front elevation view of the system 10. The path of traffic 12 may be a roadway, railway, aircraft runway, waterway, parking lot, walkway, bridge and the like. The traffic noise barrier system 10 includes a longitudinal barrier 14 and a traffic noise barrier wall 16 supported by the longitudinal barrier 14. The longitudinal barrier 14 may be any barrier extending longitudinally along at least a portion of the path of traffic 12. For example, the longitudinal barrier 14 may include one or more parapets, median barriers, bridge railings, and the like. The longitudinal barrier 14 includes a front surface 18 facing the path of traffic 12, a top surface 20 adjacent to the front surface 18, and a back surface 22 opposite the front surface 18. As can best be seen in FIG. 2, the traffic noise barrier wall 16 is spaced apart from the back surface 22 in a direction away from the path of traffic 12.

The traffic noise barrier wall 16 includes spaced-apart, vertically mounted posts 24 having panels 26 extending between each pair of posts 24. In the embodiment shown, one panel 26 is disposed between each pair of posts 24, however, it is contemplated that one or more panels 26 may be disposed between each pair of posts 24. The noise barrier wall 16 has a height above a terrain surface 28 of the path of traffic 12 that is appropriate for the particular application of the wall 16. For example, the height of the noise barrier wall 16 may be from about 4 to 18 feet, depending on the noise abatement requirements of the wall 16.

Each panel 26 is made from an acoustically absorptive and/or reflective material that is appropriate for the individual application of the traffic noise barrier wall 16. For example, the panels 26 may be made of a transparent material where it is desired that travelers on the path of traffic 12 have a view through the wall 16. One example of a preferred transparent material for use as a panel 26 is PARAGLASS SOUNDSTOP® acrylic sheet commercially available from CYRO Industries, 100 Enterprise Drive, Rockaway, N.J. Where transparency is not desired, other materials such as wood, steel, opaque acrylic, plastic, and the like, may be used. The panel 26 may be corrugated for added strength. The panel 26 may also be infused with fibers, which, in the event that the panel breaks, will hold the pieces of the panel 26 together. Acrylic panels infused with fibers are commercially available from the aforementioned CYRO Industries. The panels 26 may be interconnected by cables 30 to at least one of an adjacent panel 26 and an adjacent post 24, meaning that the panels 26 may be interconnected by cables 30 to an adjacent panel 26, an adjacent post 24, or both an adjacent panel 26 and an adjacent post 24, to secure the panel 26 to the system in the event that the panel 26 breaks or becomes dislodged from between the posts 24.

Extending between the longitudinal barrier 14 and the noise barrier wall 16 is a plurality of transverse beams 32, which transmit at least a portion (preferably all) of the weight of the noise barrier wall 16 to the longitudinal barrier 14. A structure 34 (e.g., a steel grating plate) may be disposed across the plurality of transverse beams 32 for preventing debris from falling between the longitudinal barrier 14 and the traffic noise barrier wall 16. The structure 34 also acts as a walkway for emergency or maintenance personnel. The panels 26 may include access doors (not shown) built therein to allow the emergency or maintenance personnel to access the walkway.

In the embodiment shown, the posts 24 and transverse beams 32 are formed from steel I-beams. It will be appreciated, however, that other rigid materials or structures may also be used. As can best be seen in FIGS. 2 and 5, each transverse beam 32 includes end plates 50 welded to opposite ends of the beam 32. One end plate 50 is secured to the longitudinal barrier 14 using any convenient method. In the embodiment shown, the end plate 50 is fastened to the longitudinal barrier 14 using bolts 52, which are secured within, and extend from, the back surface 22 of the longitudinal barrier 14. The opposite end plate 50 is secured to the post 24 using bolts 54, welding, or any other convenient method. The posts 24, as well as the remainder of the noise barrier wall 16, may be supported entirely by the transverse beams 32. That is, the transverse beams 32 carry the entire weight of the noise barrier wall 16 such that the noise barrier wall 16 is suspended above ground. Alternatively, the noise barrier wall 16 may be supported in part by the transverse beams 32. For example, the ends of the posts 24 may rest on the ground, bridge structure, or the like, with the transverse beams 32 providing support to hold the noise barrier wall 16 in an upright position.

Figure 5:
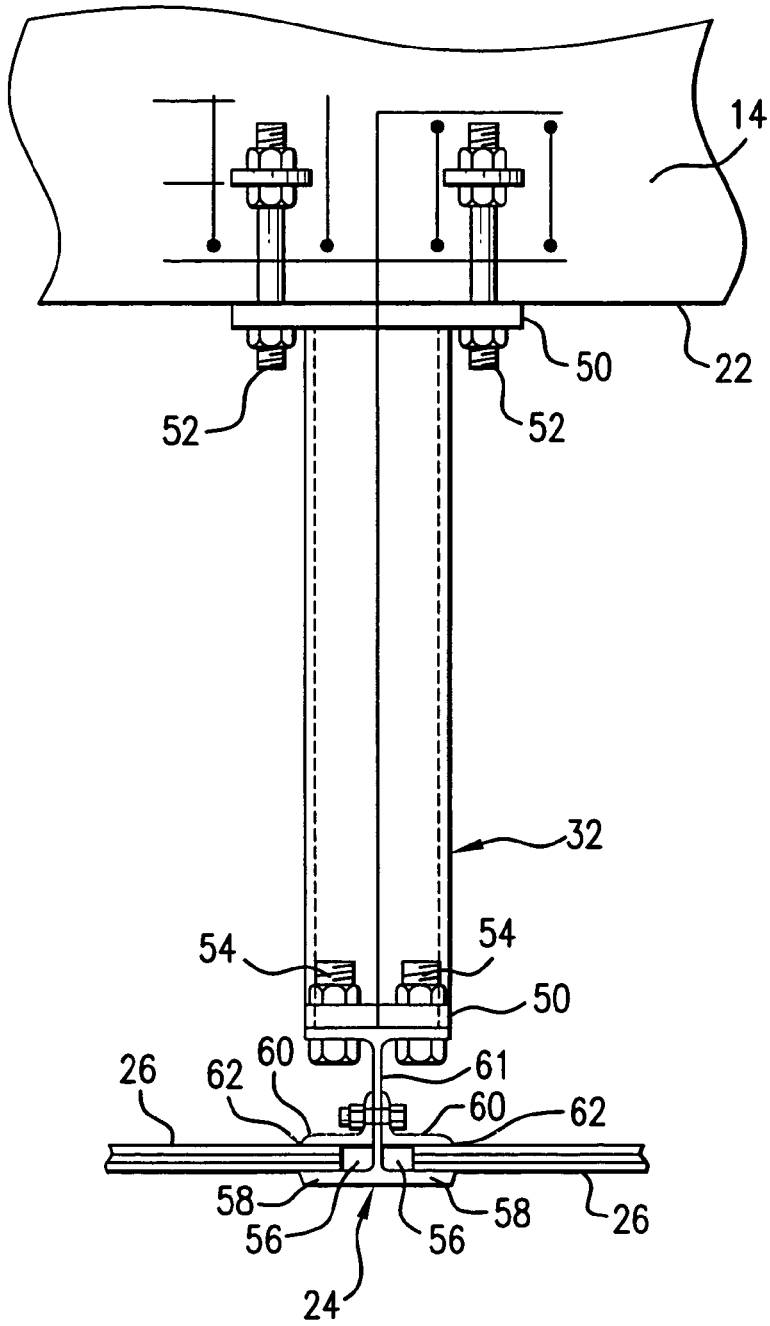
FIG. 5 is a cross-sectional plan view of a post and a transverse beam in the traffic noise barrier system.
Figure 6:
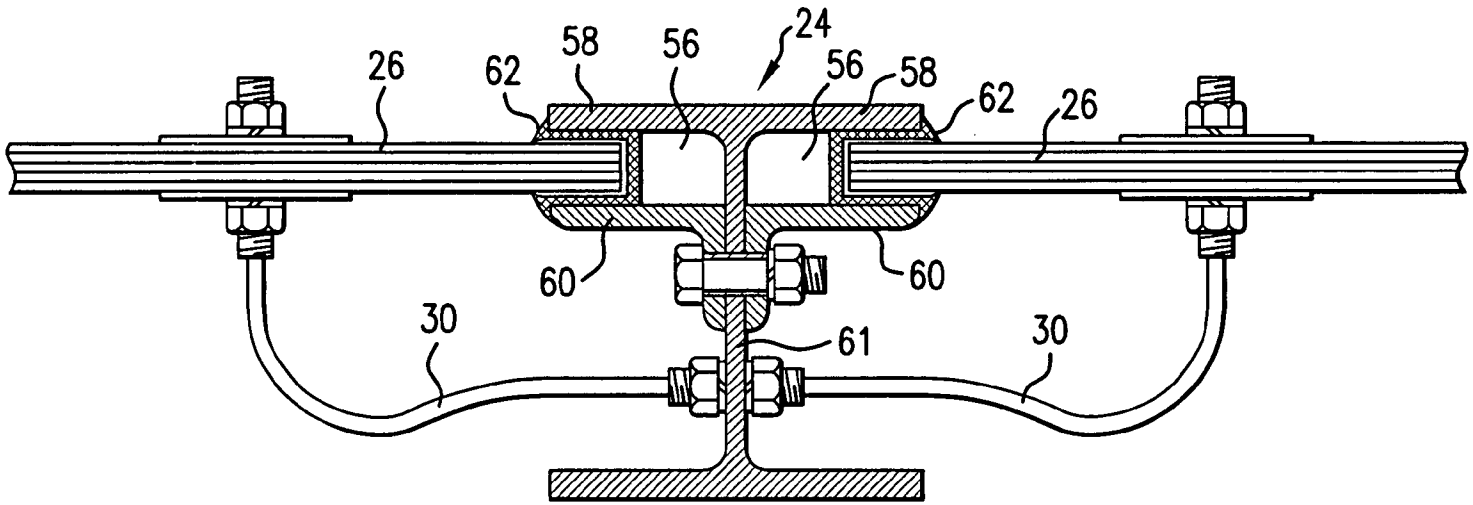
FIG. 6 is a cross-sectional plan view of a post and portions of adjacent panels in the traffic noise barrier system.

As shown in FIGS. 5 and 6, side edges of the panels 26 are secured within channels 56, which extend along the length of the posts 24. Each channel 56 is formed between a first flange 58 of the I-beam post, and a second flange 60, which is secured to a web 61 of the I-beam. An elastomeric gasket 62 may surround the edge of the panel 26 within the channel 56. Also secured to the web 61 of each post 24 are the cables 30, as can be seen in FIG. 6. Each cable 30 has a first end secured to the post 24 and a second end secured to the panel 26. The cables 30 are typically sized to withstand four times the weight of each panel 26.

Referring again to FIGS. 1–4, to prevent the posts 24 from becoming a snagging hazard, the posts 24 may be configured to bend or break upon vehicle impact. This may be accomplished through the sizing and/or material selected for the posts 24, or through the use of areas of reduced strength in the design of the upstanding posts 24. To prevent the posts 24 from becoming a debris or vehicle intrusion hazard, the posts 24 are preferably interconnected by at least one of a bar 64 and a cable, meaning that the posts may be interconnected by a bar 64, by a cable, or by combinations including both a bar 64 and a cable, such that when a post 24 or a portion of a post 24 is broken, it remains secured to the system 10.

Figure 7:
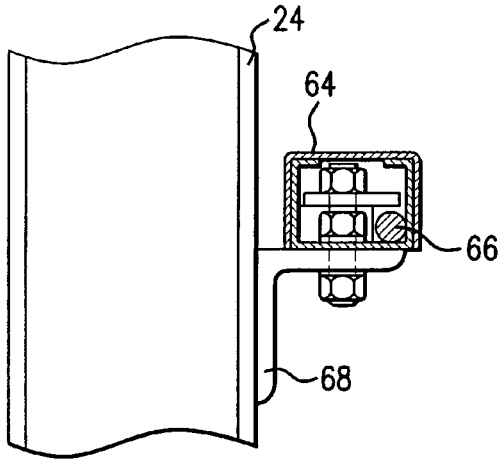
FIG. 7 is a cross-sectional side elevation view of a post support bar in the traffic noise barrier system.
Figure 8:
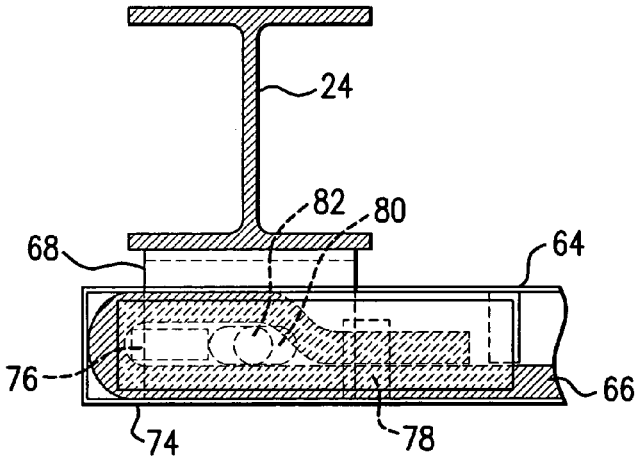
FIG. 8 is a cross-sectional plan view of an end of the post support bar.
Figure 9:
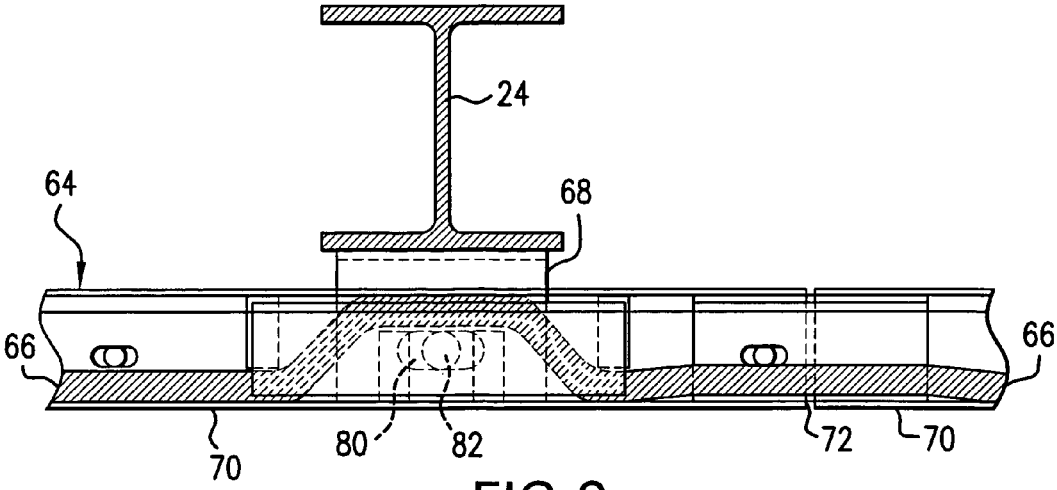
FIG. 9 is a cross-sectional plan view of a central portion of the post support bar.

FIGS. 7–9 depict an embodiment where the bar 64 is a segmented tubular bar having a cable 66 disposed therein. The segmented tubular bar 64 is secured to each post 24 by a bracket 68, and includes a plurality of segments 70 separated by expansion joints 72 for allowing relative movement of the segments 70. Such relative movement may be necessary to prevent the buildup of thermally induced stress within the bar 64.

FIG. 7 is a cross-sectional side view of the bar 64, which reveals the cable 66 disposed within the bar 64. FIG. 8 depicts an end portion 74 of the bar 64, which is typical of both end portions 74 of the bar 64 (FIG. 1). As shown in FIG. 8, the ends of the cable 66 are each wrapped around a bar 76 and secured by a clamp 78. The bar 76 is rigidly secured to the bar 64. The bar 64 includes an aperture 80 disposed therein for receiving a pin 82, which is rigidly secured to the bracket 68. The pin 82/aperture 80 arrangement secures the bar 64 to the bracket 68, while allowing limited movement of the bar 64 relative to the bracket 68. Between the end portions 74, the cable 66 runs freely within the bar 64, as depicted in FIG. 9. The bar 64, is mounted to each bracket 68 using the pin 82/aperture 80 arrangement described in FIG. 8. The travel of the expansion joints 72 may be limited by a similar pin and slot arrangement. If the bar 64 or one or more of the posts 24 is impacted by a vehicle, the bar 64 and cable 66 act together to prevent the posts 24 from being dislodged from the system 10.

Figure 10:
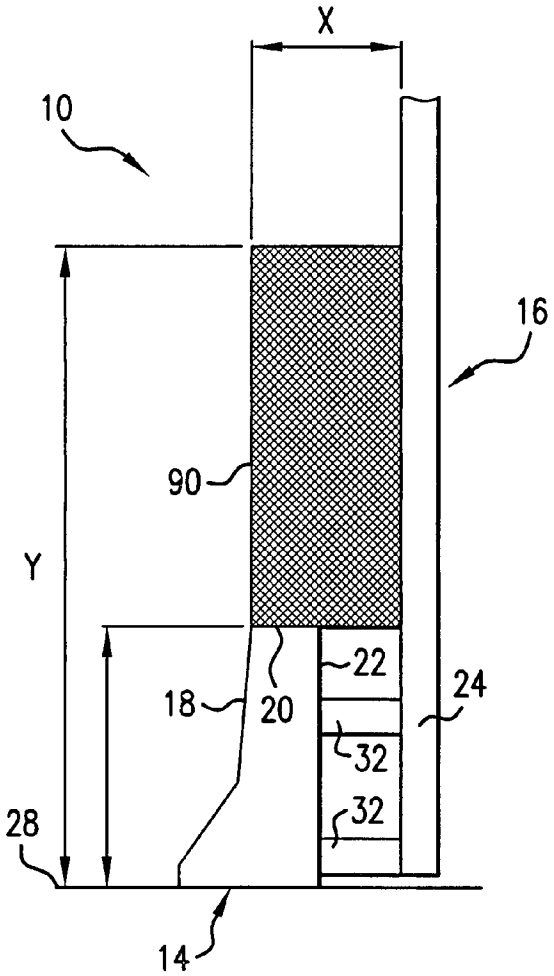
FIG. 10 is a side view of the traffic noise barrier system depicting the position of the noise barrier wall relative to a sloped-face concrete barrier.

Referring to FIG. 10, in certain applications, such as where the traffic noise barrier system 10 is used alongside a roadway, the longitudinal barrier 14 is configured to redirect an errant vehicle away from a hazard outside the normal path of the vehicle (e.g., outside the path of traffic 12 in FIG. 1). In such applications, the noise barrier wall 16 is preferably spaced apart from the longitudinal barrier 14 such that, in a region extending from the top surface 20 of the longitudinal barrier 14 to a height "y" of about 78 inches above the terrain surface 28 of the path of traffic 12, the traffic noise barrier wall 16 is positioned at a distance "x" greater than about 18 inches from a vertical plane 90 disposed at the front surface 18 of the longitudinal barrier 14. This spacing will help to ensure that the noise barrier wall 16 is outside the ZOI for most applications requiring qualification under Test Level 3 of the NCHRP Report 350. More preferably, the noise barrier wall 16 is spaced apart from the longitudinal barrier 14 such that, in a region extending from the top surface 20 of the longitudinal barrier 14 to a height "y" of about 96 inches above the terrain surface 28 of the path of traffic 12, the traffic noise barrier wall 16 is positioned at a distance "x" greater than about 34 inches from the vertical plane 90 disposed at the front surface 18 of the longitudinal barrier 14. This spacing will help to ensure that the noise barrier wall 16 is outside the ZOI for most applications requiring qualification under Test Level 3 or Test Level 4 of the NCHRP Report 350. The maximum distance "x" between the longitudinal barrier 14 and the noise barrier wall 16 is dictated by the particular structure used and the amount of space available outside the path of traffic 12. For practical purposes, the maximum distance for "x" is preferably about 80 inches.

Figure 11:
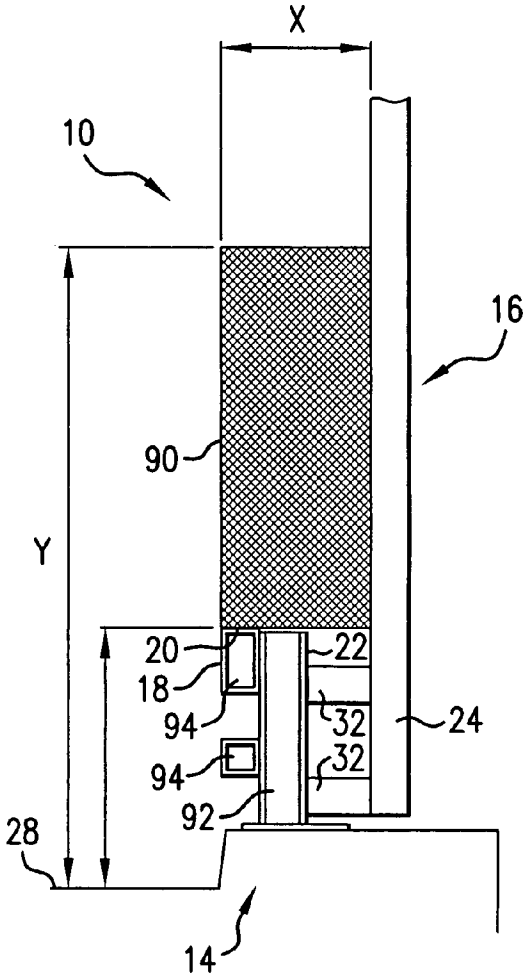
FIG. 11 is a side view of the traffic noise barrier system depicting the position of the noise barrier wall relative to a steel tubular barrier on a curb.
Figure 13:
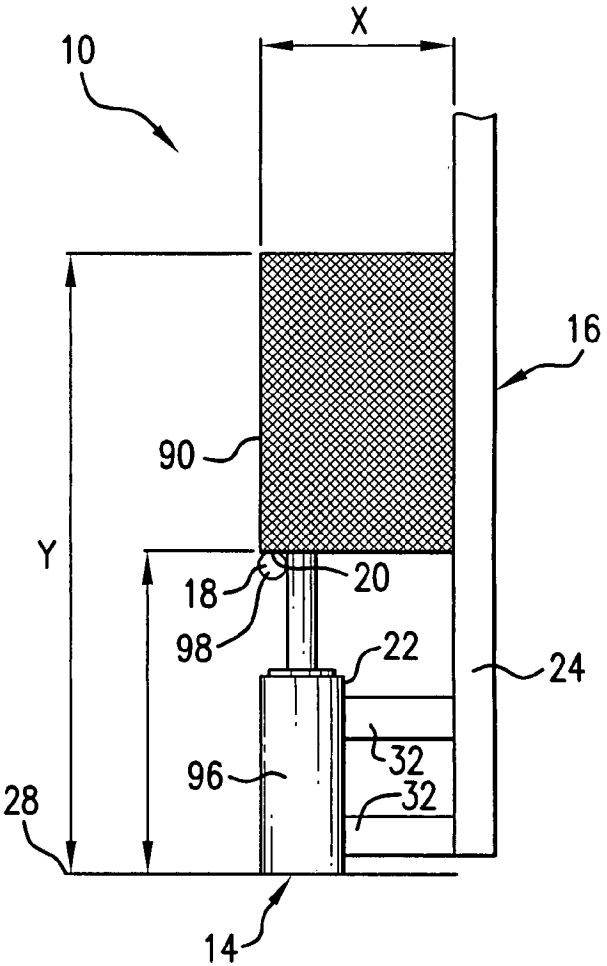
FIG. 13 is a side view of the traffic noise barrier system depicting the position of the noise barrier wall relative to a combination barrier.
Figure 12:
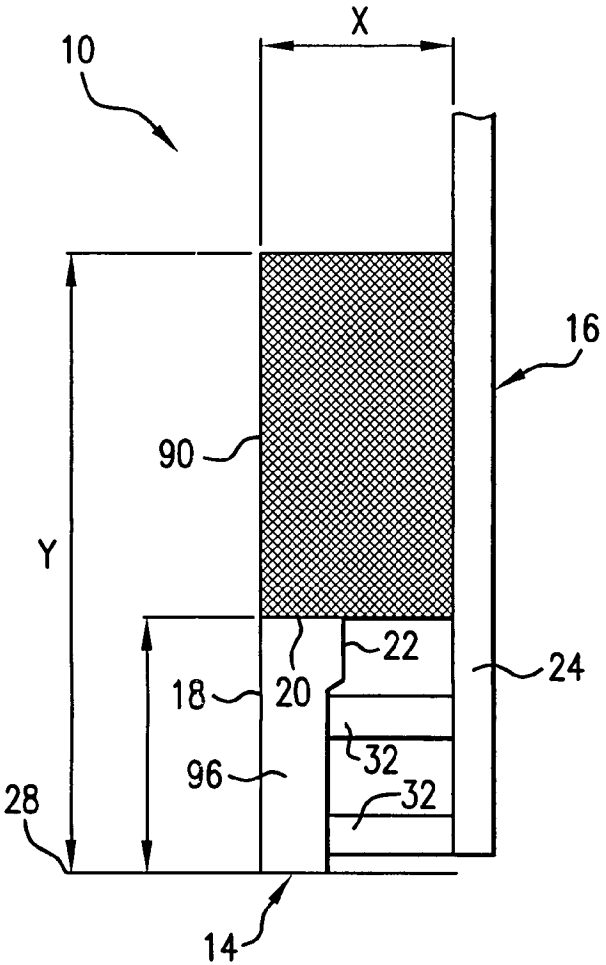
FIG. 12 is a side view of the traffic noise barrier system depicting the position of the noise barrier wall relative to a vertical faced concrete barrier.
Figure 15:
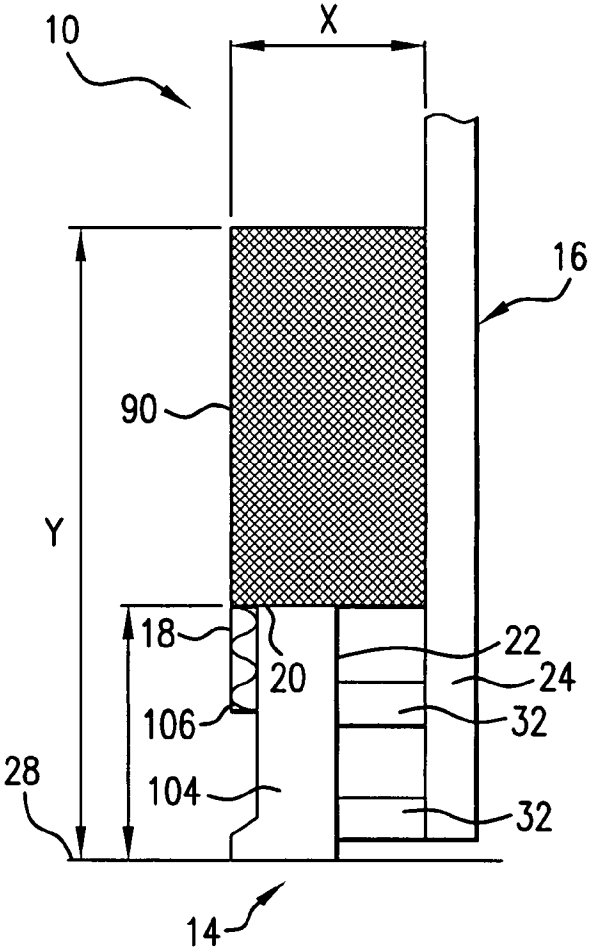
FIG. 15 is a side view of the traffic noise barrier system depicting the position of the noise barrier wall relative to a corrugated beam barrier.
Figure 14:
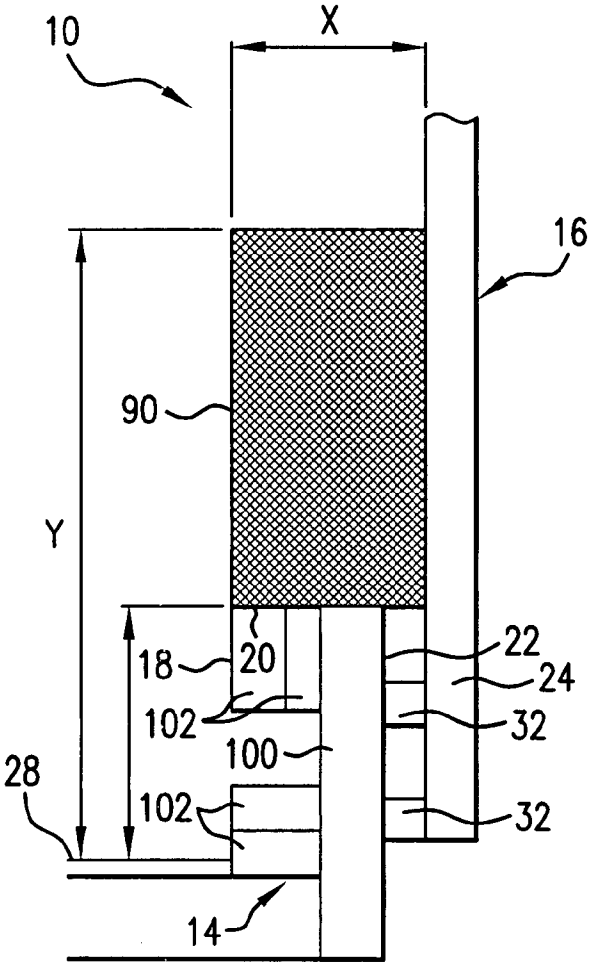
FIG. 14 is a side view of the traffic noise barrier system depicting the position of the noise barrier wall relative to a timber barrier.

In the embodiments of FIGS. 1–4 and 10, the longitudinal barrier 14 is shown as a slope-faced concrete parapet commonly known as a Jersey barrier. It is contemplated, however, that any known kind of barrier may be used, including other sloped-face concrete parapets (e.g., Single Slope, F-shape, and open concrete rail), vertical-faced concrete parapets (e.g., vertical wall and open concrete rail), steel corrugated rails (e.g., W-beam and thrie beam), steel tubular rails, steel tubular rails on curbs, combination concrete and steel tube railings, and timber bridge rails. For example, FIG. 11 depicts the traffic noise barrier system 10 wherein the longitudinal barrier 14 is a steel tubular barrier on a curb. Such longitudinal barriers are typically constructed from a plurality of spaced apart posts 92 having steel tubes 94 disposed thereon facing traffic. Where such longitudinal barriers 14 are used, the transverse beams 32 are coupled to the posts 92 by welding, fasteners, or the like. The remainder of the traffic noise barrier system 10 is the same as that described with reference to FIGS. 1–10. FIG. 12 depicts the traffic noise barrier system 10 wherein the longitudinal barrier 14 is a vertical-faced concrete parapet 96, and FIG. 13 depicts the traffic noise barrier system 10 wherein the longitudinal barrier 14 is a combination concrete parapet 96 with a steel tubular railing 98 mounted on top. FIG. 14 depicts the traffic noise barrier system 10 wherein the longitudinal barrier 14 is a timber barrier. The timber barrier includes a plurality of upstanding posts 100 or a concrete parapet having timber beams 102 mounted thereon facing traffic. FIG. 15 is a side view of the traffic noise barrier system 10 wherein the longitudinal barrier 14 is a corrugated beam barrier. The corrugated beam barrier includes a concrete parapet 104 or a plurality of upstanding posts with a corrugated steel railing 106 mounted facing traffic. The corrugated steel railing 106 may be, for example, a thrie beam or a W-beam. In any of the embodiments described herein, the longitudinal barrier 14 may be mounted on a curb, in the ground, to the side of a bridge, or to any other convenient location.

The traffic noise barrier system 10 of the present invention provides a traffic noise barrier wall 16 supported by a longitudinal barrier 14, with the traffic noise barrier wall 16 being spaced apart from the back surface 22 in a direction away from the path of traffic 12. Because the traffic noise barrier wall 16 is spaced apart from the longitudinal barrier 14, the wall 16 will present less of a hazard to traffic than prior-art designs, where the wall is located atop the longitudinal barrier. By spacing the wall 16 apart from the longitudinal barrier 14, there is less chance that a vehicle will impact the wall 16 and, as a result, less chance that the wall 16 will present snagging, debris, or vehicle intrusion hazards. Where the traffic noise barrier wall 16 is spaced apart from the front surface 18 of the longitudinal barrier 14 by more than 18 inches (preferably more than 34 inches), this chance is minimized even further. In addition, the use of breakaway posts 24 further reduces snagging hazards associated with the wall 16, and the interconnection of the posts 24 help to ensure that they will not become a debris hazard or vehicle intrusion hazard. Finally, the use of fiber infused panels 26 and the interconnection of the panels 26 by cables 30 helps to ensure that the panels 26 will not become a debris hazard or vehicle intrusion hazard.

A number of embodiments of the present invention have been described. Nevertheless, it will be understood that various modifications may be made without departing from the spirit and scope of the invention. Accordingly, other embodiments are within the scope of the following claims.

What is claimed is:

1. A traffic noise barrier system for use alongside a path of traffic, the traffic noise barrier system comprising:

a longitudinal barrier including:

a front surface facing the path of traffic and configured to redirect an errant vehicle, a top surface adjacent the front surface, and a back surface opposite the front surface; and a traffic noise barrier wall supported by the longitudinal barrier and spaced apart from the back surface in a direction away from the path of traffic, wherein the traffic noise barrier wall includes:

a plurality of upstanding posts spaced apart from the back surface of the longitudinal barrier in the direction away from the path of traffic, a plurality of transparent panels supported by the plurality of upstanding posts, and a plurality of load-bearing transverse, relative to said longitudinal barrier and to said plurality of transparent panels, beams each extending from the back surface of the longitudinal barrier to one upstanding post in the plurality of upstanding posts for supporting the traffic noise barrier wall wherein in a region extending from the top surface of the longitudinal barrier to about 96 inches above a terrain surface of the path of traffic, the traffic noise barrier wall is positioned at a distance greater than about 34 inches from a vertical plane disposed at the front surface of the longitudinal barrier forming a Zone of Intrusion buffer effective to reduce vehicle impact with the transparent panels lessening a hazards from falling debris, vehicle snagging and vehicle intrusion.

2. The traffic noise barrier system of claim 1, wherein each panel in the plurality of panels is interconnected by a cable to at least one of an adjacent panel and an upstanding post.

3. The traffic noise barrier system of claim 1, wherein the at least one panel is infused with fibers.

4. The traffic noise barrier system of claim 1, wherein the upstanding posts are configured to break upon impact by a vehicle.

5. The traffic noise barrier system of claim 1, wherein the traffic noise barrier wall is entirely supported by the longitudinal barrier.

6. The traffic noise barrier system of claim 1, further comprising:

a structure disposed across the plurality of transverse beams for catching debris falling between the longitudinal barrier and the traffic noise barrier wall.

7. The traffic noise barrier system of claim 6, wherein the structure is a grating plate formed from a rigid material.

8. The traffic noise barrier system of claim 1, wherein adjacent upstanding posts in the plurality of upstanding posts are interconnected by at least one of a bar and a cable extending between the adjacent upstanding posts.

9. The traffic noise barrier system of claim 8, wherein the adjacent upstanding posts are interconnected by a segmented tubular bar having a cable disposed therein, the segmented tubular bar including a plurality of segments separated by expansion joints for allowing relative movement of the segments.

10. A traffic noise barrier system for use alongside a path of traffic, the traffic noise barrier system comprising:

a longitudinal barrier including:

a front surface facing the path of traffic with the front surface is configured to redirect an errant vehicle, a top surface adjacent the front surface, and a back surface opposite the front surface;

a transparent traffic noise barrier wall supported by the longitudinal barrier and spaced apart from the back surface in a direction away from the pat of traffic; and a plurality of load-bearing transverse, relative to said longitudinal barrier and to said traffic noise barrier wall, beams each having a first end coupled to the back surface of the longitudinal barrier and a second end coupled to the traffic noise barrier wall for supporting the traffic noise barrier wall wherein in a region extending from the top surface of the longitudinal barrier to about 96 inches above a terrain surface of the path of traffic, the traffic noise barrier wall is positioned at a distance greater than about 34 inches from a vertical plane disposed at the front surface of the longitudinal barrier forming Zone of Intrusion buffer effective to reduce vehicle impact with the transparent panels lessening a hazards from falling debris, vehicle snagging and vehicle intrusion.

11. The traffic noise barrier system of claim 10, further comprising:

a structure disposed across the plurality of transverse beams for catching debris falling between the longitudinal barrier and the traffic noise barrier wall.

12. The traffic noise barrier system of claim 10, wherein the traffic noise barrier wall includes:

a plurality of upstanding posts; and a plurality of panels supported by the plurality of upstanding posts, each panel in the plurality of panels being interconnected by a cable to at least one of an adjacent panel and an upstanding post.

13. The traffic noise barrier system of claim 10, wherein the panels are infused with fibers.

14. The traffic noise barrier system of claim 10, wherein the traffic noise barrier wall is entirely supported by the longitudinal barrier.

15. The traffic noise barrier system of claim 10, wherein the traffic noise barrier wall includes:

a plurality of upstanding posts; and a plurality of panels supported by the plurality of upstanding posts, and wherein adjacent upstanding posts in the plurality of upstanding posts are interconnected by at least one of a bar and a cable extending between die adjacent upstanding posts.

16. The traffic noise barrier system of claim 12, wherein the adjacent upstanding posts are interconnected by a segmented tubular bar having a cable disposed therein, the segmented tubular bar including a plurality of segments separated by expansion joints for allowing relative movement of the segments.

17. The traffic noise barrier system of claim 12, wherein the upstanding posts are configured to break upon impact by a vehicle.

18. A traffic noise barrier system for use alongside a path of traffic, the traffic noise barrier system comprising:

a longitudinal barrier including:

a front surface facing the path of traffic, a top surface adjacent the front surface, and a back surface opposite the front surface;

a traffic noise barrier wall including:

a plurality of upstanding posts spaced apart from the back surface of the longitudinal barrier by at least 30 inches in a direction away from the path of traffic, and a plurality of transparent panels supported by the plurality of upstanding posts; and a plurality of load-bearing transverse, relative to said longitudinal barrier and to said plurality of transparent panels, beams each having a first end coupled to the longitudinal barrier and a second end coupled to the traffic noise barrier wall for supporting the traffic noise barrier wall forming a Zone of Intrusion buffer effective to reduce vehicle impact with the transparent panels lessening a hazards from falling debris, vehicle snagging and vehicle intrusion.

19. The traffic noise barrier system of claim 18, further comprising: a structure disposed across the plurality of transverse beams for catching debris falling between the longitudinal barrier and the traffic noise barrier wall.

20. The traffic noise barrier system of claim 18, wherein the at least one panel is infused with fibers.

21. The traffic noise barrier system of claim 18, wherein the traffic noise barrier wail is entirely supported by the longitudinal barrier.

22. The traffic noise barrier system of claim 18, wherein the adjacent upstanding posts are interconnected by a segmented tubular bar having a cable disposed therein, the segmented tubular bar including a plurality of segments separated by expansion joints for allowing relative movement of the segments.

23. The traffic noise barrier system of claim 22, wherein the upstanding posts are configured to break upon impact by a vehicle.

24. A traffic noise barrier system for use alongside a path of traffic, the traffic noise barrier system comprising:

a longitudinal barrier including:

a front surface facing the pat of traffic and configured to redirect an errant vehicle, a top surface adjacent the front surface, and a back surface opposite the front surface;

a traffic noise barrier wall including:

a plurality of upstanding posts spaced apart from the back surface of the longitudinal barrier, adjacent upstanding posts in the plurality of upstanding posts are interconnected by at least one of a bar and a cable extending between the adjacent upstanding posts, and a plurality of transparent panels supported by the plurality of upstanding posts, each panel in the plurality of panels is interconnected by a cable to at least one of an adjacent panel and an upstanding post; and a plurality of load-bearing transverse, relative to said longitudinal barrier and to said plurality of transparent panels, beams each having a first end coupled to the longitudinal barrier and a second end coupled to the traffic noise barrier wall for supporting the traffic noise barrier wall, wherein, in a region extending from the top surface of the longitudinal barrier to about 96inches above a terrain surface of the path of traffic, each upstanding post in the plurality of upstanding posts is positioned at a distance greater than about 34 inches from a vertical plane disposed at the front surface of the longitudinal barrier forming a Zone of Intrusion buffer effective to reduce vehicle impact with the transparent panels lessening a hazards from falling debris, vehicle snagging and vehicle intrusion.

25. The traffic noise barrier system of claim 24, wherein the panels are infused with fibers.

26. The traffic noise barrier system of claim 24, wherein the adjacent upstanding posts are interconnected by a segmented tubular bar having a cable disposed therein, the segmented tubular bar including a plurality of segments separated by expansion joints for allowing relative movement of the segments.

27. The traffic noise barrier system of claim 24, wherein the upstanding posts are configured to break upon impact by a vehicle.

28. The traffic noise barrier system of claim 24, further comprising:

a structure disposed across the plurality of transverse beams for catching debris falling between the longitudinal barrier and the traffic noise barrier wall.

29. The traffic noise barrier system of claim 24, wherein the traffic noise barrier wall is entirely supported by the longitudinal barrier.

* * * * *